United States Patent [19]

Pasquini

[11] Patent Number: 4,744,303

[45] Date of Patent: May 17, 1988

[54] RAILWAY TRACK TAMPING MACHINE

[75] Inventor: Sandro Pasquini, La Tour-de-Peilz, Switzerland

[73] Assignee: Kershaw Manufacturing Co., Inc., Montgomery, Ala.

[21] Appl. No.: 6,704

[22] Filed: Jan. 23, 1987

[30] Foreign Application Priority Data

Feb. 27, 1986 [CH] Switzerland ..... 00790/86

[51] Int. Cl.[4] ..... E01B 27/16

[52] U.S. Cl. ..... 104/12

[58] Field of Search ..... 104/10–15

[56] References Cited

U.S. PATENT DOCUMENTS

| | | | |
|---|---|---|---|
| 3,292,558 | 12/1966 | Oville . | |
| 3,357,366 | 12/1967 | Plasser et al. . | |
| 3,589,297 | 6/1971 | Plasser et al. | 104/12 |
| 3,608,498 | 9/1971 | Plasser et al. | 104/12 |
| 3,625,156 | 12/1971 | Anderson | 104/12 |
| 4,094,251 | 6/1978 | Theurer | 104/12 |
| 4,130,063 | 12/1978 | Theurer et al. | 104/12 |
| 4,258,627 | 3/1981 | Theurer | 104/12 |

FOREIGN PATENT DOCUMENTS

| | | |
|---|---|---|
| 3424667 | 5/1985 | Fed. Rep. of Germany . |
| 2374470 | 7/1978 | France . |
| 401116 | 4/1966 | Switzerland . |
| 470536 | 5/1969 | Switzerland . |
| 569837 | 11/1975 | Switzerland . |

*Primary Examiner*—Joseph F. Peters, Jr.
*Assistant Examiner*—Stephen P. Avila
*Attorney, Agent, or Firm*—Anthony J. Casella; Gerald E. Hespos

[57] ABSTRACT

The tamping machine is equipped with tool holders (7) on which each of the two tools (8) of a pair of tamping tools is connected by a cylinder-piston unit (28), via an eccentric arm (25, 25′), to one of the two eccentrics (24, 24′) of the output shaft (33) of a forced oscillation generator. Each of the two eccentric arms (25, 25′) has, in addition to its articulation to one of the two eccentrics, a second articulation connected directly to a hydraulic cylinder-piston unit (28) and a third articulation (29) connected by a connecting link (30) to a pivot (31) fastened on the tool holder, said last connection having the purpose of immobilizing the two eccentric arms in rotation around the eccentric shaft (33). This transmission of movements, designed to facilitate the maintenance of the hydraulic cylinder-piston units (28), is also shown applied to two and three pairs of tamping tools juxtaposed in the same plane.

11 Claims, 3 Drawing Sheets

RAILWAY TRACK TAMPING MACHINE

The object of the present invention is a railway track tamping machine having a rolling chassis which is equipped for each of the two lines of rails, with at least one tamping unit comprising a frame connected to the rolling chassis; a tool holder which is vertically movable on the frame; at least one pair of tamping tools the two lever-shaped tools of which, each equipped with at least one pick with end tappet are articulated pivotally in opposition to each other in a vertical plane parallel to the track on two shafts which are rigidly connected to the tool holders; a forced oscillation generator installed on the tool holder with its output shaft perpendicular to said plane and having two eccentrics of opposite eccentricities; two eccentric arms each articulated by a ring to one of the two eccentrics and each immobilized in rotation around the latter by connection to a pivot fastened to the tool holders; and two hydraulic cylinder-piston units each articulated to one of the two tools of the pair or tamping tools and each established in indirect connection with one of the two eccentrics so as to transmit the forced oscillations in phase opposition to these tools and control their pivoting.

There are various types of railway-track tamping machines based on the method of creating the tamping forces and of transmitting the forced oscillations by means of hydraulic cylinder-piston units.

In all of these tamping machines, these hydraulic cylinder-piston units supply considerable work and are subject to high pressure due to the resistance of the ballast to compression during the moving together of the pick stops of the pair of tools around and below a tie and the stresses due to the forced oscillations which agitate them alternately in one direction and the other at frequencies on the order of 30 to 50 Hz, depending on the compacting theories applied.

This has the result that a large part of the maintenance work on the tamping units of these tamping machines consists of repair to or replacement of these cylinder-piston units which have become defective or unusable due to excessive fatigue.

On certain known tamping machines having a single pair of tamping tools on each rail line side, such as the two tamping machines described in published French Patent Application No. 2 374 470 and published German Patent Application No. 34 24 667, the hydraulic cylinder-piston unit which controls the pivoting of a tamping tool is integral with an eccentric arm and is thus connected directly to an eccentric. This has the result that the removal of this cylinder-piston unit for its repair or replacement also requires the removal of the articulation of its arm on the eccentric. This latter task is lengthy and difficult and can be carried out only in the shop, which immobilizes the tamping machine for the time of removal and reinstallation.

This operation of the repair or replacement of a defective cylinder-piston unit of this type is even more difficult and time-consuming on tamping machines having socalled "multiple" units on which pairs of tools are juxtaposed on the tool holders in the same plane so as simultaneously to tamp two or three adjacent ties, depending on the arrangement of the pairs of tools.

On two known tamping machines of this type, described in Swiss Patent No. 470 536 and U.S. Pat. No. 4,094,251 respectively, each of the two eccentric arms has a first articulation formed of its ring articulated to an eccentric, and is on the one hand integral with the driving cylinder-piston unit of one of the two inner tamping tools and, on the other hand, has a second articulation remote from the eccentric shaft to which articulation there is articulated the cylinder-piston unit which actuates one of the two outer tools.

This arrangement, while it makes it possible easily to remove two of the four cylinder-piston units since these two cylinder-piston units are articulated at their ends independently of the eccentric nevertheless requires the removal of the eccentric arm to which they are articulated when the cylinder-piston unit which is integral with said arm must be removed for repair or replacement.

This, combined with the fact that the cylinder-piston units of the inner tools suffer substantially the same stresses as those of the outer tools, does not result, in the final analysis, in any advantage with respect to the maintenance of the said tamping machines having a single pair of tamping tools per rail line side and complicates even more the removal and reinstallation of an eccentric lever.

Another principle of transmitting movements to the tamping tools is applied to a known tamping machine described in Swiss Patent No. 569 837 in which the tool holders are adapted for the simultaneous tamping of three directly adjacent ties upon each advancing step.

Each of the tool holders of this tamping machine has, per rail line side, three juxtaposed pairs of tamping tools, two tools of each pair being articulated at their central portion on two different shafts in opposition to each other on opposite sides of the three ties to be tamped. The six shafts thus defined are each fixed on an individual slide mounted for displacement in the longitudinal direction of the track on two parallel slideways between which there are installed six hydraulic cylinder-piston units which control their displacements. Furthermore, the six tamping tools of this arrangement are connected at their upper ends to an eccentric shaft via four separate eccentric arms so that the two tools of each pair vibrate in phase opposition and that the two tools juxtaposed in each of the two spaced between ties which surround the central tie vibrate in phase synchronism.

In this way the six hydraulic cylinder-piston units serve here merely to impart to the tamping tools their pivoting movement around the six shafts and no longer transmit the forced oscillations to them from the eccentric shaft. However, as a result of reaction of the ballast to the combined tamping forces by compression and forced oscillations of the tamping tools, the latter transmit to these hydraulic cylinder-piston units, and via their articulations on the slides, a significant part of the stresses generated by these oscillations. This has the result that, here also, these hydraulic cylinder-piston units are subject to substantial fatigue and their removal and reinstallation for overhaul or replacement constitute time-consuming and difficult operations which can be carried out only in the shop, due to their position in a difficulty accessible region between the two slideways and the slides on which the tamping tools are articulated. The advantage is thus minor as compared with the necessity of removing the eccentric arm of the said tamping machines for these same operations of installing and removing the hydraulic cylinder-piston units which activate the tamping tools.

On the known tamping machines of a type similar to that of the invention, the removal of the cylinder-piston units actuating the tamping tools no longer requires the removal of the eccentric arm, which constitute an advance with regard to maintenance.

On one of these tamping machines having a single pair of tamping tools per rail line side, described in Swiss Patent No. 401 116, and in one of the embodiments shown, each of the two eccentric arms has a first articulation formed by its ring which is articulated to an eccentric and a second elongated articulation of said eccentric which is connected to an intermediate lever articulated moreover to a pivot fastened to the tool holder and on which lever the hydraulic cylinder-piston unit which actuates a tamping tool is articulated.

In this way, each of the two eccentric arms is immobilized in rotation around the eccentric by the intermediate lever and the forced oscillations are transmitted to the hydraulic cylinder-piston unit and to the tamping tool via the said lever.

In this structure, each of the two actuating cylinder-piston units for the tamping tools can be removed by simple removal of their two end articulations, without the necessity of removing the eccentric arm. However, it should be pointed out that this advantage with respect to maintenance is obtained at the expense of an increase in the number of parts connecting a tamping tool to the eccentric, and therefore an increase in the weight of the parts subjected to the forced oscillations and also an increase in the space taken up by this transmission.

The same principle of indirect transmission of the forced oscillations to the hydraulic cylinder-piston unit actuating each tamping tool is applied on a known tamping machine having two juxtaposed pairs of tools per rail line side described in U.S. Pat. No. 3,608,498, which thus enjoys the same advantage relative to the maintenance of the cylinder-piston units which actuate all of its tamping tools. In this tamping machine, each of the two eccentric arms has a first articulation consisting of its ring articulated to an eccentric and a second articulation remote from said eccentric and connected to an intermediate lever in the shape of a rocker arm articulated in its central portion to a pivot fastened on the tool holder and at its two ends to the two cylinder-piston units actuating the two tools of one of the two juxtaposed pairs of tamping tools.

In this way, here also, each of the two eccentric arms is immobilized in rotation around the eccentric by the intermediate lever. The forced oscillations themselves are transmitted in phase opposition to the two hydraulic cylinder-piston units actuating the two tools of a pair of tamping tools from a single eccentric arm, these two cylinder-piston units being connected to the two ends of the rocker arm formed by the intermediate lever to which this eccentric arm is articulated.

This particular arrangement of the transmission of movements to the four tools of two pairs of tamping tools juxtaposed in the same plane has the result that the four cylinder-piston units actuating these tools can be easily removed by simple removal of their end articulations, without requiring the removal of the eccentric arm.

However, in the same way as on the previously mentioned tamping machine which has a single pair of tamping tools per rail line side, it must be pointed out that this advantage relative to maintenance is obtained here also at the expense of an increase in the number of parts connecting the tamping tools to the eccentrics, an increase in their weight, and also an increase in the space taken up by them. In particular, the alternate stresses suffered by each of the two intermediate levers treated as rocker arm are considerable, with the result that their dimensions and weight are necessarily also considerable.

Furthermore, and this is also important, this concept results in an elevated positioning, on the tool holder, of the eccentric shaft with respect to the level of the upper articulations of the tamping tools connected to the hydraulic cylinder-piston units actuating these tools. Furthermore, this same spatial constraint is found in a tamping machine previously mentioned, described in Swiss Patent No. 470 536. This elevated position of the eccentric shaft has the indirect result of raising the part of the rolling chassis of the tamping machine below which such tamping units are installed and this is an additional drawback with respect to the visibility required from the operator's cab for the operating of the tamping machine when running light.

The object of the invention is to retain the advantage with reference to the maintenance, easy removal and reinstalling of the hydraulic cylinder-piston units actuating the tamping tools when these cylinder-piston units have to be repaired or replaced, without thereby offsetting this advantage by an increase in the number, volume and weight of the parts transmitting the movement between an eccentric and a tamping tool.

For this purpose, the tamping machine of the invention, which is of the type described at the start hereof, is characterized by the fact that each of the two eccentric rams is formed by a lever which comprises, in addition to the ring for articulation to an eccentric, at least one second articulation remote from said eccentric and connected directly to a hydraulic cylinder-piston unit which controls the pivoting of a tamping tool, and a third articulation remote from the second articulation and from the eccentric and connected to the pivot fastened to the tool holder.

In this way, this reliable structural solution which is of great simplicity makes it possible to avoid the interposing of an intermediate lever between the eccentric arm and each of the two cylinder-piston units which control the pivoting of the two tools of a pair of tamping tools, without thereby requiring that each of these cylinder-piston units be integral with an eccentric arm.

This structural solution therefore retains the advantage of the simplicity and rapidity of the removal of these hydraulic cylinder-piston units for maintenance and permits the development of a compact transmission, of minimum weight and space, both for a tamping machine equipped with a single pair of tools and for a tamping machine equipped with two pairs of tamping tools juxtaposed in the longitudinal direction of the track, per rail line side.

For this type of tamping machine having two pairs of tamping tools, the description which follows points out the additional advantages offered by this basic concept.

The description which follows also points out the possibility of applying the solution according to the invention to tamping machines equipped with tamping units suitable for the simultaneous tamping, upon each advancing step, of three directly adjacent ties, without thereby losing the advantages relative to the maintenance of the hydraulic cylinder-piston units and without requiring furthermore any increase in the number of transmission members between an eccentric and the tamping tools which are connected to it.

The accompanying drawing shows by way of example five embodiments of the object of the invention.

Figure 1:
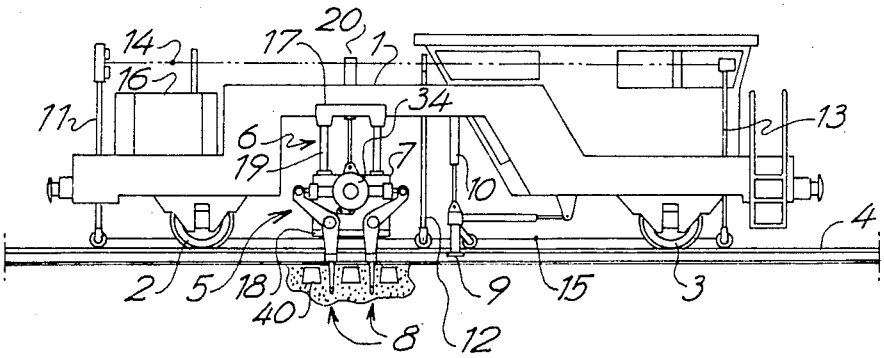
FIG. 1 is an overall side view of a tamping machine in accordance with the first embodiment.

The tamping machine which is shown in its entirety in FIG. 1 is suitable for the tamping, leveling and aligning of railway tracks on the open line by a step-by-step advance from one tie to the next.

This tamping machine comprises:

a rolling chassis 1 having two axles 2 and 3 shown as resting on the rails 4 of a railway track, three of the ties 40 of which are diagrammatically shown;

a tamping unit 5 per line of track arranged between the two axles 2 and 3 and comprising a frame 6 mounted here fastened to the rolling chassis 1 and a tool holder 7 which is movable vertically in the frame and bears a pair of pivoting and oscillating tamping tools 8 on each side of the line of rails 4;

a device 9 for the shifting of the track connected to the rolling chassis 1 by cylinder-piston units 10 for controlling the vertical and transverse shifting of the track, only the cylinder-piston units controlling the vertical displacement being visible here;

a device for controlling the geometry of the track, represented here diagrammatically by three rail feelers 11, 12 and 13 bearing at their upper part a light beam levelling measurement baseline 14 and at their lower part a measurement baseline for the alignment of the line track 15.

All the power systems of this tamping machine are fed by a power plant 16.

Aside from the tamping unit 5 which characterizes the invention, the equipment indicated may be of any known type suitable for the purposes set forth and the rolling chassis 1 of the tamping machine shown as well as this equipment can serve as basis for a tamping machine equipped with tamping units in accordance with the other embodiments shown.

It is pointed out here that railway track tamping machines, which have already been described at length in specialized articles, make it possible to lift and shift the track as they advance so as to bring it into or return it to its required position by means of the shifting device 9, and under the control of the level and alignment measurement baselines, and to consolidate the position thus obtained by tamping the ballast by compression and vibration below the ties by means of tamping tools.

The tamping operation is carried out in steps of one or more ties depending on the number of tamping tools and in accordance with an operating cycle of predetermined amplitudes comprising, for each advancing step, a vertical plunging of the tools into the ballast, the tamping operating proper, the raising of the tools above the upper level of the ties and, finally, the advancing of the tamping machine by one step for the next cycle.

Figure 2:
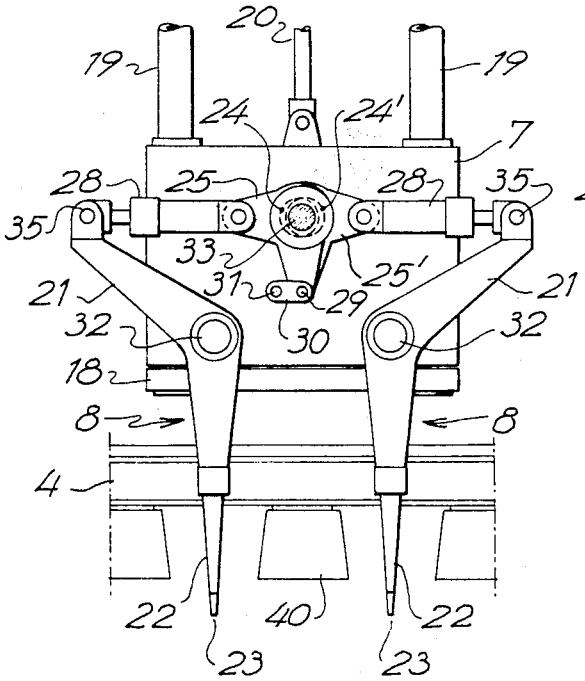
FIG. 2 is a side view of the tamping unit which characterizes it.

The frame 6 of the tamping unit, shown in FIG. 1 and in part in FIG. 2, is in the form of a vertical frame formed of an upper cross member 17 fastened to the rolling chassis 1 and a lower cross member 18 connected to the upper cross member by two parallel cylindrical uprights 19, along which the tool holder is vertically displaceable by means of a hydraulic cylinder-piston unit 20.

The tool holder 7 has two pairs of tamping tools 8 arranged symmetrically with respect to the line of rails 4, only one of which is visible, the other pair is located on the other side of the tool holder being identical. The two tools 8 of each pair which have the form of bent levers 21 provided with picks 22 having end tappets 23 are pivotally articulated in opposition to each other in a vertical plane parallel to the track on two shafts 32 which are rigidly attached to the tool holder. This tool holder 7 also has a forced-oscillation generator the output shaft 33 of which, perpendicular to said plane, is visible in section in FIG. 2 and has, for each pair of tools 8, two eccentric portions 24 and 24' of opposite eccentricities shown in dashed line and a dynamic balancing flywheel 34 shown in FIGS. 1 and 2.

The pivoting of the two tamping tools 8 is controlled by two hydraulic cylinder-piston units 27 each connected at its two ends on the one side by its rod to an articulation 35 of the upper end of a tamping tool 8 and on the other side by its cylinder to an eccentric arm 25 and 25' respectively, it self articulated on an eccentric 24 or 24' respectively of the eccentric shaft 33.

Figure 3:
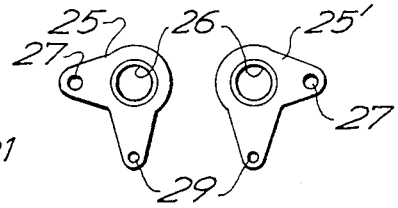
FIG. 3 is a side view of the two eccentric arms of this tamping unit.

The two eccentric arms 25 and 25', shown clearly in FIG. 3, are exactly similar but articulated symmetrically with respect to a vertical plane passing through the axis of the shaft 33 and through a ring 26, one 25 on the eccentric 24 and the other 25' on the eccentric 24'. Each of these two eccentric arms has, in addition to its articulation ring 26, a second articulation 27 remote from the eccentric and connected directly to a hydraulic cylinder-piston unit 28 which controls the pivoting of a tamping tool 8, and a third articulation 29 remote from the second articulation and from the eccentric, in this case vertically below the shaft 33. This third articulation 29 of each of the two eccentric arms 25 and 24' is connected by a connecting link 30 to a pivot 31 which is rigidly fastened to the tool holder 7, which connection has the effect of immobilizing each of these two eccentric arms in rotation around the eccentric shaft 33.

Figure 4:
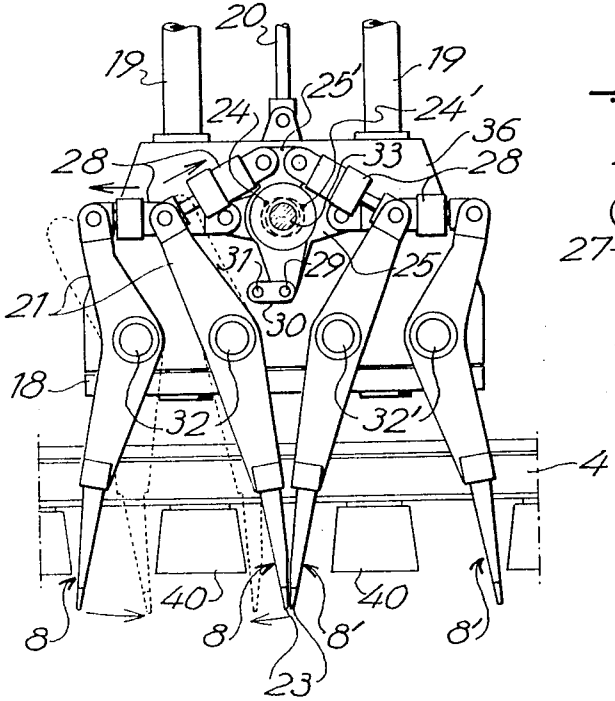
FIG. 4 is a side view of a tamping unit according to the second embodiment.

In its second embodiment, the tamping machine is equipped with tool holders 36 such as the one shown in FIG. 4, comprising, per rail line side 4, two pairs of tamping tools 8 and 8' juxtaposed in the longitudinal direction of the track so as to be able simultaneously to tamp two directly adjacent ties 40 upon each advancing step, its four tools being articulated on four separate shafts 32, 32'.

This tool holder 36 is connected to the rolling chassis 1 of the tamping machine in the same manner as in the preceding example by a frame the two uprights 19 and the lower cross member 18 of which can be seen here as well as the rod of the hydraulic cylinder-piston unit 20 which controls its upward displacement along these two uprights. This tool holder 36 also has a forced oscillation generator with output shaft 33 having two eccentrics 24 and 24' of opposite eccentricities to which there are articulated two eccentric arms 25 and 25' respectively, shown in detail in FIG. 6, which are here of different shape from each other.

One of these eccentric arms, arm 25, has, in addition to its ring 26 for articulation to the eccentric 24, two second articulations 27 remote from each other and on the horizontal line of the said eccentric, they being connected directly to the two hydraulic cylinder-piston units 28 controlling the pivoting of the outer tamping tools 8 and 8', and a third articulation 29 which, as in the preceding example, is connected by a connecting link 30 to a pivot 31 fastened to the tool holder.

The other eccentric arm 25' differs from the arm 25 by the fact that its two second articulations 27 are located above the ring 26 and are connected directly to the two hydraulic cylinder-piston units 28 which control the pivoting of the two inner tamping tools 8 and 8'.

Thus connected to the two eccentrics 24 an 24' of the eccentric shaft 33, the two tools of each pair which surround a tie 40 are imparted forced oscillations in phase opposition and the two inner tools 8 and 8', each belonging to a different pair and which must plunge together into the space between the two ties are imparted forced oscillations in phase synchronism, which latter effect may be preferred to the opposite effect in order to permit the two tappets 23 of the picks of these two tools to come together as closely as possible and thus facilitate their penetrating into the ballast.

In this structure for the transmission of movements to the four tamping tools from the eccentric shaft 33, the two cylinder-piston units for the actuating of the two inner tools and the two cylinder-piston units for the actuation of the two outer tools are arranged in two parallel planes, due to the fact that they intersect as seen in side view, and the levers 21 of these tools are slightly bent for this purpose in a direction perpendicular to the plane of their pivoting.

It will be noted that the movement of rapprochement around a tie 40 of the two tools of each pair, such as the two tools 8 of the left-hand pair, is obtained by retraction of the cylinder-piston unit actuating the inner tool and extension of the cylinder-piston unit actuating the outer tool, as is indicated by the two small arrows shown above these two cylinder-piston units. This has the result that the first said cylinder-piston unit works via its large section while the second works via its small annular section during the tamping stroke of the tools which they drive.

Figure 5:
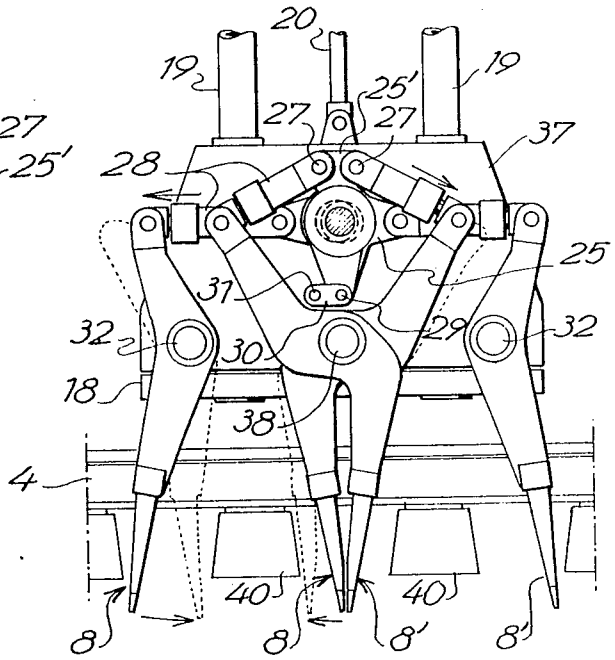
FIG. 5 is a side view of a tamping unit according to the third embodiment.

In the third embodiment, shown in FIG. 5, which also refers to a tool holder 37 having two pairs of tamping tools 8 and 8' juxtaposed in the longitudinal direction of the track, the four hydraulic cylinder-piston units work via their large section during the tamping stroke of the four tools.

This result is obtained in the manner that on this tool holder 37 the two inner tools 8 and 8' which belong to two different pairs are both articulated on one and the same shaft 38, in the manner of the two arms of a pair of scissors.

This design of the two inner tools 8 and 8' results in effect in a reversing of the connections of the two cylinder-piston units 28 actuating these two inner tools on the two articulations 27 of the eccentric arm 25', as well as a reversing of the direction of displacement of the piston in these two cylinder-piston units during the tamping stroke as compared with the second embodiment, shown in FIG. 4, as is indicated by the two small arrows appearing above the two cylinder-piston units actuating the two tools 8 of the left-hand pair of tamping tools.

Figure 6:
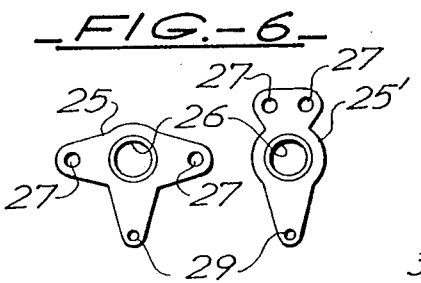
FIG. 6 is a side view of the two eccentric arms of the tamping units according to the second and third embodiments.

Aside from these differences, the other parts of this structure are identical to the corresponding ones in FIG. 4, including also the two eccentric arms 25 and 25', shown in detail in FIG. 6.

This third embodiment, like the first two, satisfies well the desired purpose of facilitating the removal and reinstallation of the hydraulic cylinder-piston units 28 which control the pivoting of all the tamping tools without requiring the interposition of additional levers between them and the eccentric arms 25 and 25'.

However, in addition, this third embodiment, which permits the previously indicated effect of causing all four cylinder-piston units 28 to work via their large section during the tamping stroke, affords the additional advantage, with respect to the desire for minimum size and weight of the transmission for the movement of the two inner tools, of being able to connect to the two latter, two cylinder-piston units of the same useful minimum cross section as the two other cylinder-piston units driving the two outer tools.

This additional advantage is also obtained in the fourth and fifth embodiments shown in FIGS. 7 to 10, which show a possibility of applying the solution of the invention to tamping units suitable for the partial or complete simultaneous tamping, upon each advancing step, of three ties 40 directly adjacent to each other.

Figure 7:
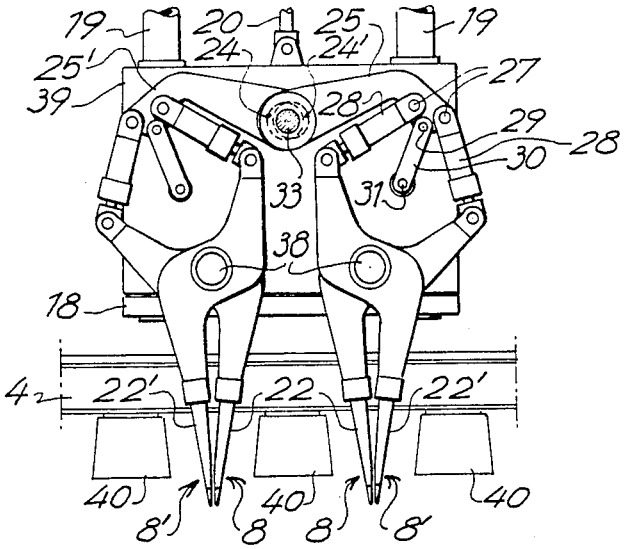
FIG. 7 is a side view of a tamping unit according to the fourth embodiment.
Figure 8:
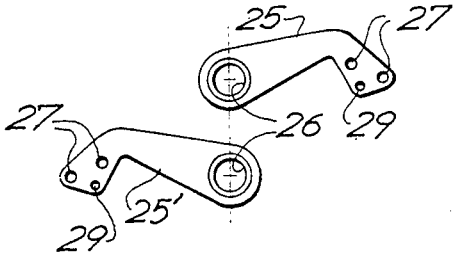
FIG. 8 is a side view of the two eccentric arms of the tamping unit according to the fourth embodiment.

In the fourth embodiment, shown in FIGS. 7 and 8, the tool holder 29 of a tamping unit has, per rail line side, two pairs of tamping tools 8 and 8' interleaved in each other in such a manner that the two picks 22 of the pair of tools 8 surround the central tie 40 and that the two picks 22' of the pair of tools 8' are juxtaposed to the two picks 22 of the first pair to the outside of the latter. The two tools 8 and 8' whose picks 22 and 22' are juxtaposed within the same space between ties are articulated on a common shaft 38 in the manner of the two arms of a pair of scissors, like the central tools of the third embodiment, shown in FIG. 5, and the two hydraulic cylinder-piston units 28 which control the pivoting of these two tools 8 and 8' are connected directly to the same eccentric arm, 25 and 25' respectively.

In this way, the two tools 8 and 8' of each pair vibrate in phase opposition, the two tools 8 and 8' juxtaposed in each space between the ties vibrate in phase synchronism and the four hydraulic cylinder-piston units 28 work via their large section during the tamping stroke of the four tools. It will be noted here that the tamping stroke takes place by the opening of the two tools 8 and 8' whose picks 22 and 22' are juxtaposed in the same inter-tie space.

The two eccentric arms 25 and 25' of this fourth embodiment, shown in detail in FIG. 8, are bent and exactly similar, but they are articulated symmetrically with respect to a vertical plane passing through the axis of the shaft 33 and through a ring 26, one 25 on the eccentric 24 and the other 25' on the eccentric 24'. These two arms both have two second articulations 27 spaced on the same side from the eccentric and connected to the two hydraulic cylinder-piston units 28 which control the two tools 8 and 9 articulated on the same shaft 38, and a third articulation 29, located here between the two second articulations 27 and connected by a connecting link 30 to a pivot 31 fastened to the tool holder 39.

In the fifth embodiment, shown in FIGS. 9 and 10, the tool holder 41 of a tamping unit has, per rail line side, three pairs of tamping tools 8, 8' and 8'' juxtaposed one after the other in order to tamp the ballast on both sides of and below three directly adjacent ties 40.

In the arrangement shown, each of the two tools 8 of the central pairs is articulated to an inner tool, 8' and 8'' respectively, of one of the two end pairs on a common shaft 38 in the manner of the corresponding tools of the fourth embodiment, shown in FIG. 7, and two outer tools, 8' and 8'' respectively, of these two end pairs are each articulated on a shaft 32 independently of the others.

In this arrangement, the two tools, 8 and 8' and 8 and 8'' respectively, which are articulated on a common shaft 38, are connected to an eccentric arm, 25, 25' respectively, by two hydraulic cylinder-piston units 28 precisely in the same manner as in the preceding embodiment. However here, each of these two eccentric arms has, in addition, a third second articulation 27 which is located on the other side of the two others with respect to the eccentricl shaft 33 and on which there is articulated an extension 42 of the hydraulic cylinder-piston unit 28 which controls the pivoting of an outer tool 8' or 8'' respectively.

Figure 10:
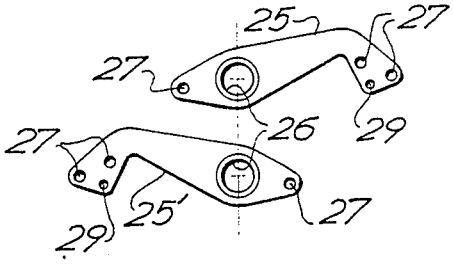
FIG. 10 is a side view of the two eccentric arms of the tamping unit according to the fifth embodiment.
Figure 9:
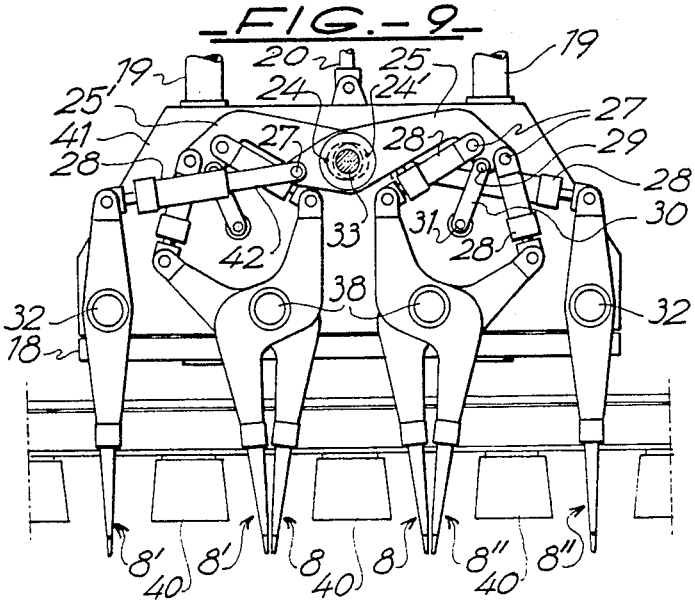
FIG. 9 is a side view of a tamping unit according to the fifth embodiment.

The arrangement of this third second articulation 27 opposite the two others is clearly shown in FIG. 10, which also clearly shows that each of the two eccentric arms 25 and 25' has, in addition to the ring 26 for articulation to an eccentric, three second articulations 27 connected in the manner which has just been stated and a third articulation 29 connected—see FIG. 9—by a connecting link 30 to a pivot 31 fastened to the tool holder 41.

In this way, here also, the two tools of each of three pairs vibrate in phase opposition, the two tools juxtaposed in each inter-tie space vibrate in phase synchronism and the six hydraulic cylinder-piston units 28 work via their large section during the tamping stroke of the six tools.

Of course, to the extent that the two eccentric arms 25 and 25' are arranged, connected and immobilized in rotation around the eccentric shaft 33 in accordance with the teaching of the invention, the invention is applicable to all known modes of actuating tamping tools. In particular, in the case of tamping machines equipped with tamping units having two pairs of tools juxtaposed in the longitudinal direction of the track, the two inner tools intended to plunge together into one and the same inter-tie space can be connected differently to the eccentric arms so as to be imparted oscillations in phase opposition, when this is desired. This effect can easily be obtained by no longer connecting the two cylinder-piston units actuating the two inner tools as well as those of the two outer tools on the same eccentric arm but, rather, connecting one of these two cylidner-piston units on one eccentric arm and the other on the other arm.

It is obvious also that the invention can be applied to track tamping machines on which the tamping tools are displaceable in the transverse direction of thet rack and/or retractable individually by lifting above the level of the running surface of the track by means of motors or hydraulic cylinder-piston units which are independent of the cylinder-piston units 28 which control the working pivoting of these tools.

Finally, the connection by connecting link 30 of the third articulation 29 of each eccentric arm 25, 25' to the pivot 31 fastened to the tool holder, which has the great advantage of its simplicity and reliability, may, however, be replaced by an equivalent means such as, for instance, that consisting of a connection formed of a slide articulated on a pivot 31 and an opening in the form of a slideway in the eccentric arm, in which the said slide engages.

I claim:

1. A railway track tamping machine with rolling chassis equipped, for each of two lines of rails, with at least one tamping unit having a frame connected to the rolling chassis, a tool holder which is vertically movable on the frame, at least one pair of tamping tools the two tools of which, in the form of levers each equipped with at least one pick with end tappet are artciulated, pivoting in opposition to each other, in a vertical plane parallel to the respective rail on two shafts rigidly attached to the tool holder, a forced oscillation generator installed on the tool holder with output shaft perpendicular to said plane and having two eccentrics of opposite eccentricity, two eccentric arms each articulated by a ring to one of the two eccentrics and each immobilized in rotation around said eccentric by connection to a pivot fastened to the tool holder, and two hydraulic cylinder-piston units each articulated to one of the two tools of the pair of tamping tools and each established in indirect connection with one of the two eccentrics so as to transmit to these tools the forced oscillations in phase opposition and control their pivoting, characterized by the fact that each of the two eccentric arms (25, 25') is formed by a lever comprising, in addition to the ring (26) for articulation to an eccentric (24, 24') at least one second articulation (27) remote from the respective eccentric and connected directly to a hydraulic cylinder-piston unit (28) which controls the pivoting of the respective tamping tool, and a third articulation (29) remote from the second articulation and from the associated eccentric and connected to the pivot (31) which is fastened to the tool holder.

2. A tamping machine according to claim 1, in which the tool holder comprises, per rail line side, two pairs of tamping tools juxtaposed in the longitudinal direction of the rail and the four tools of which are articulated on four separate shafts, characterized by the fact that each of the two eccentric arms (25, 25') is constituted by a lever having, in addition to the ring (26) for articulation to an eccentric (24, 24'), two second articulations (27) remote from the associated eccentric and connected directly to two hydraulic cylinder-piston units (28) for the driving of the pivoting of two of said tamping tools, and a third articulation (29) remote from the two second articulation and from the associated eccentric and connected to the pivot (31) which is fastened to the tool holder.

3. A tamping machine according to claim 1 in which the tool holder comprises, per rail line side, two pairs of tamping tools juxtaposed in the longitudinal direction of the rail, the two outer tools of which are articulated on two separate shafts and the two inner tools of which are articulated on a common shaft in the manner of the two arms of a pair of scissors, characterized by the fact that each of the two eccentric arms (25, 25') is constituted by a lever comprising, in addition to the ring 926) for articulation to an eccentric (24, 24'), two second articulations (27) remote from the associated eccentric and connected directly to two hydraulic cylinder-piston units (28) which control the pivoting of two of said tamping tools, and a third articulation (29) remote from the two second articulations and from the associated eccentric and connected to the pivot (31) which is fastened to the tool holder.

4. A tamping machine according to claim 3, characterized by the fact that on one saide eccentric arm (25) the two second articulations are connected directly to the two cylinder-piston units which control the pivoting of the two outer tools articulated on two separate shafts, while on the other eccentric arm (25') the two second articulations are connected directly to the two hydraulic cylinder-piston units which control the pivoting of the two inner tools articulated on a common shaft.

5. A tamping machine according to claim 1, in which the tool holder comprises, per rail line side, two pairs of tamping tools interleaved one within the other so as to form four tools articulated two by two on a common shaft in the manner of the two arms of a pair of scissors, characterized by the fact that each of the two eccentric arms (25, 25') is formed by a lever comprising, in addition to the ring (26) for articulation to an eccentric (24, 24'), two second articulations (27) remote from the respective eccentric and connected directly to the two hydraulic cylinder-piston units (28) which control the pivoting of the two tamping tools (8, 8') which are articulated on the same common shaft (38), and a third articulation (29) which is remote from the two second articulations and the associated eccentric and is connected to the pivot (31) which is fastened to the tool holder.

6. A tamping machine according to claim 1, in which the tool holder comprises, per rail line side, three pairs of tamping tools juxtaposed in the longitudinal direction of the track, the two end tools of which are each articulated on a separate shaft and the four inner tools of which are articulated two by two on a common shaft in the manner of the two arms of a pair of scissors, characterized by the fact that each of the two eccentric arms (25, 25') is formed by a lever comprising, in addition to the ring (26) for articulation to an eccentric (24, 24'), three second articulations (27) remote from said associated eccentric, two of which are connected directly to the two hydraulic cylinder-piston units (28) which control the pivoting of two tamping tools articulated on the same common shaft (38) and the last of which is connected directly to the hydraulic cylinder-piston unit (28) which controls the pivoting of an outer tamping tool articulated on a separate shaft (32), and a third articulation (29) remote from the three second articulations and from the associated eccentric and connected to the pivot (31) which is fastened to the tool holder.

7. A tamping machine according to claim 1, characterized by the fact that the third articulation (29) of each eccentric arm is connected to the pivot (31) by a connecting link (30) articulated, on the one hand, to said third articulation (29) and on the other hand to said pivot (31).

8. A tamping machine according to claim 2 characterized by the fact that the third articulation (29) of each eccentric arm is connected to the pivot (31) by a connecting link (30) articulated, on the one hand, to said third articulation (29) and on the other hand to said pivot (31).

9. A tamping machine according to claim 3, characterized by the fact that the third articulation 929) of each eccentric arm is connected to the pivot (31) by a connecting link (39) articulated, on the one hand, to said third articulation (29) and on the other hand to said pivot (31).

10. A tamping machine according to claim 5, characterized by the fact that the third articulation (29) of each eccentric arm is connected to the pivot (31) by a connecting link (30) articulated, on the one hand, to said third articulation (29) and on the other hand to said pivot (31).

11. A tamping machine according to claim 6, characterized by the fact that the third articulation (29) of each eccentric arm is connected to the pivot (31) by a connecting link (30) articulated, on the one hand, to said third articulation (29) and on the other hand to said pivot (31).

* * * * *

UNITED STATES PATENT AND TRADEMARK OFFICE

CERTIFICATE OF CORRECTION

PATENT NO. : 4,744,303

DATED : May 17, 1988

INVENTOR(S) : Sandro Pasquini

It is certified that error appears in the above—identified patent and that said Letters Patent is hereby corrected as shown below:

Claim 2, line 13, delete "articulation" and insert --articulations--.

Claim 3, line 9, delete "926)" and insert --(26)--.

Claim 4, line 2, delete "saide" and insert --said--.

Claim 9, line 2, delete "929)" and insert --(29)--.

Claim 9, line 4, delete "(39)" and insert -- (30)--.

Signed and Sealed this

Twenty-second Day of November, 1988

*Attest:*

DONALD J. QUIGG

*Attesting Officer*

*Commissioner of Patents and Trademarks*